United States Patent [19]

Stevens et al.

[11] 4,178,667

[45] Dec. 18, 1979

[54] METHOD OF CONTROLLING TURBOMACHINE BLADE FLUTTER

[75] Inventors: Eloy C. Stevens, Indianapolis; Kenneth Swain, Lizton, both of Ind.

[73] Assignee: General Motors Corporation, Detroit, Mich.

[21] Appl. No.: 883,688

[22] Filed: Mar. 6, 1978

[51] Int. Cl.[2] ..... B23P 15/02; G01M 1/32

[52] U.S. Cl. ..... 29/156.8 B; 29/407; 416/241 R; 416/500; 73/583; 73/147; 73/456

[58] Field of Search ..... 29/156.8 B, 407; 73/456, 583, 147; 416/500, 241 R, 241 A, 241 B

[56] References Cited

U.S. PATENT DOCUMENTS

| | | | |
|---|---|---|---|
| 3,044,746 | 7/1962 | Stargardter | 29/156.8 B |
| 3,368,795 | 2/1968 | Bolin et al. | 29/156.8 B |
| 3,600,103 | 8/1971 | Gray | 416/241 |
| 3,796,513 | 3/1974 | Jonas | 416/500 |

OTHER PUBLICATIONS

Whitehead, D. S., "Torsional Flutter of Unstalled Cascade Blades at Zero Deflection," from Technical Information & Library Services Ministry of Aviation, S and T Memo 12/63, Mar. 1964, Great Britain.

Snyder, L. E., "Supersonic Unstalled Torsional Flutter", from L. E. Synder SQUID Publication, pp. 164–183, Jun. 1972.

Troha, et al., "Composite Inlays Increase Flutter Resistance of Turbine Engine Fan Blades," from ASME Publication 76-GT-29, Dec. 11, 1975.

*Primary Examiner*—Daniel C. Crane

*Attorney, Agent, or Firm*—J. C. Evans

[57] ABSTRACT

A method for controlling the first torsional node line position in a rotatable blade of a turbomachine to improve its flutter stability including the steps of forming a first monolithic blade having a desired airfoil shape with convex and concave side walls; arranging several of the monolithic blades in a cascade array and subjecting the cascade array to an unsteady, supersonic, transonic and subsonic flow condition thereacross and thereafter determining the unsteady surface pressures acting on the monolithic blades; independently determining the first torsional mode vibration node line of each of the monolithic blades and comparing the resultant unsteady pressure force on the monolithic blades and its relationship to the first torsional mode vibration node line to determine whether or not the monolithic blade is absorbing or adding energy to the air flow thereacross; thereafter forming a plurality of first and thereafter modified composite blades by adding dissimilar material to the blade shape of a monolithic blade within the confines of its convex and concave side walls with the location of the dissimilar material and the amount of the dissimilar material being determined by subjecting the first composite blades and modifications thereof to unsteady, supersonic, transonic and subsonic flow conditions while the first composite blades and modification thereof are located in a cascade array and determining the resultant unsteady surface pressures thereon and comparing such unsteady surface pressures to the location of an independently determined node line position of the first composite blades and modifications thereof so as to optimize the location of their first torsional mode node line with respect to unsteady surface pressures produced thereon under unsteady, supersonic, transonic and subsonic flow conditions so as to produce a flutter stable blade.

3 Claims, 12 Drawing Figures

METHOD OF CONTROLLING TURBOMACHINE BLADE FLUTTER

The invention herein described was made in the course of work under a contract or subcontract thereunder with the Department of Defense.

This invention relates to turbomachine blades and more particularly to methods for improving the flutter stability of such turbomachine blades.

Axial flow type turbomachines include rows of airfoil configured compressor or fan blades, each having a relatively rigidly connected portion and each further including a radially outwardly directed blade having an airfoil shape with convex and concave surfaces thereon joined at leading and trailing edges. With the advent of lower hub/tip radius ratio fan stages such blades have required means for restraining both blade bending and torsional movements. In such compressor or fan blade configurations, supersonic, as well as other blade flutter can impose a limit on the operation of the compressor or fan. The installed supersonic flutter generally occurs in a torsional mode near the compressor operating line where the outer portion of the blade operates at a supersonic relative flow condition with a subsonic axial component. Such flutter can be diminished or eliminated by increasing the pressure ratio of the fan as it traverses a constant speed line. However, this approach is limited because high speed operation near the compressor surge line can lead to supersonic stall flutter. Flutter in the bending mode has also generally been associated with higher pressure ratios.

Another type of supersonic flutter is encountered near the compressor operating line. It is characterized by the possibility of flutter free operation along an operating line that is either above or below the flutter region. This type of flutter has been referred to as A100 type supersonic flutter since it was first encountered during the development of a fan stage of the same name.

Various approaches have been utilized to control the aforesaid kinds of compressor or fan blade flutter. One approach has been to control the torsional vibration frequency of the blade. For example, as illustrated in U.S. Pat. No. 3,044,746, issued July 17, 1962, to Stargardter, torsional frequency is regulated by configuring the blade to have a high fundamental torsional frequency without a corresponding increase in the fundamental flexural frequency of the blades. The stiffness distribution to accomplish the aforesaid arrangement is promised in part on prior known principles that blades would have improved flutter stability if the natural torsional frequency of the blades is shifted upward.

U.S. Pat. No. 3,796,513, issued Mar. 12, 1974, to Jonas, teaches the use of high damping material disposed in a blade depression to control blade vibration characteristics. This patent recognizes that rotatable blades in a turbomachine may be damped by modification of blade material characteristics without requiring clappers or other physical restraints between adjacent ones of the blades to decrease excessive vibrations therein. However, the method is dependent upon material characteristics and vibration damping caused by the material change.

The prior publication "Composite Inlays Increase Flutter Resistance of Turbine Engine Fan Blades," ASME publication 76-GT-29, Mar. 21, 1976, by W. Troha and K. Swain, discloses the use of unshrouded titanium blades in a compressor first stage rotor of the type which experience torsional flutter at supersonic rotor inlet Mach numbers. The paper discloses the use of composite inlay patches within the confines of an airfoil to produce improved flutter resistance. While it is generally recognized that it is desirable to include patches of inlay material having greater stiffness than the base material of a blade, maximized flutter resistance was not always predictable because the composite blade structure could produce blade aerodynamic damping with some degree of flutter resistance because of changes in the frequency of vibration of the blade produced solely by blade stiffness changes. Alternatively, gains in flutter resistance could be attributable to a positioning of the first torsional node line at an offset relationship with respect to the leading edge of the monolithic blades on which the composite material inly was placed. Furthermore, at the time of the aforesaid ASME publication it was recognized, that in theory, the position of the torsional axis of the blade along the chord line of the blade could be of great importance. For example, on an analytical basis it could be shown that the best position of torsion axis location would be near the quarter chord point, in other words located between the leading edge and the center of gravity of the blade. Furthermore, it could be shown that the worst position of the torsional axis for torsional flutter would be near the three-quarter chord point. The torsional node line portion is important to flutter stability in axial flow type compressors as set forth in S&T Memo 12/63 entitled "Torsional Flutter of Unstalled Cascade Blades at Zero Deflection" by D. S. Whitehead, issued March 1964, by Technical Information Library Services, Ministry of Aviation, Great Britain.

The importance of torsional node line position is also set forth in an article "Supersonic Unstalled Torsional Flutter" by L. E. Snyder. This article appeared in the June 1972 Project SQUID publication "Aeroelasticity in Turbomachines".

In order to maintain maximum compressor efficiency and pressure ratio, the steady state flow analyst may recommend that the point of maximum thickness be moved well aft of midchord. However this will shift a first torsional mode node line rearwardly of the center of gravity and increase susceptibility to flutter. Accordingly, a further approach has been to lower the aspect ratio (span to chord ratio) of such fan blades so as to raise the reduced frequency of the fan blade to improve its aerodynamic damping characteristics. However, in order to maintain desired air flow and aerodynamically desired characteristic shapes in such fan blades, it is desirable to minimize changes in the span-to-chord ratio for a given blade having desired aerodynamic characteristics. Accordingly, an inlay of dissimilar material, for example, a material having a different modulus of elasticity or a different density, is placed in the monolithic blade within the shape of the airfoil as set forth in the aforesaid ASME paper. However, trial and error location of such a blade inlay can produce blade configurations that have an improved flutter stability because of increased blade stiffness (which would change the frequency of the blade) but which produce greater flutter instability overall because of an improper location of the torsional node line with respect to the center of gravity of the blade.

Accordingly, an object of the present invention is to provide improved flutter stability in a composite turbomachine blade structure by an improved method for accurately locating the first torsional mode node line of the blade under engine operating conditions by determining the unsteady surface pressures acting on the blade and thereafter independently establishing the first torsional mode and vibration characteristics of the blade with the unbalanced pressures thereon to determine whether or not the blade is either adding energy to or extracting energy from an unsteady supersonic and subsonic air flow thereacross and to adjust the position of the first torsional mode node line in accordance with such determination in order to optimize the location of the torsional node line so that when the blades are placed in a cascade array and subjected to an unsteady supersonic and subsonic condition of flow thereacross the unsteady surface pressures thereon and the resultant first torsional node line location will be such that the modified composite blade structure will no longer absorb energy from the air flow thereby to indicate an optimized blade configuration for flutter stability therein.

Yet another object of the present invention is to provide an improved method for controlling the first torsional mode node line position in a rotatable blade of a turbomachine to improve the flutter stability thereof including the steps of forming a monolithic blade having a relatively rigidly connected root portion and an unrestrained airfoil shaped radial extent with convex and concave side walls; arranging a plurality of such blades in a cascade array and subjecting them to unsteady, supersonic, transonic and subsonic conditions of flow thereacross to determine unsteady surface pressures on each of the monolithic blades; thereafter elastically deforming one of said blades to produce a first torsional mode vibration to locate the first torsional node line on the blade and thereafter comparing the torsional node line location with the unsteady surface pressures and resultant force as produced by unsteady, supersonic, transonic and subsonic conditions of flow across the blade to determine whether the blade is either absorbing energy from or adding energy to the air flow thereacross; changing the first torsional node line position by adding dissimilar materials to the blade within the confines of the convex and concave side walls thereof and resubjecting the blades to the aforesaid unsteady, supersonic, transonic and subsonic flow conditions to produce a second set of unsteady surface pressures and resultant force on the first composite blade which is then compared to the first torsional vibration mode shape of the first composite blade to redetermine whether or not the first composite blade is absorbing energy from or contributing energy to the air flow thereacross; and comparing the energy absorption characteristics of the monolithic blade with that of the first composite blade to provide a further adjustment and refinement of the location of the first torsional node line of a modified first composite blade and subjecting it to further unsteady, supersonic, transonic and subsonic airflow thereacross until the torsional node line location and unsteady surface pressures on the modified composite blades are correlated to cause the modified blade to direct energy into the air flow thereby to indicate a blade design optimized against flutter instability.

Further objects and advantages of the present invention will be apparent from the following description, reference being had to the accompanying drawings wherein a preferred embodiment of the present invention is clearly shown.

Figure 8:
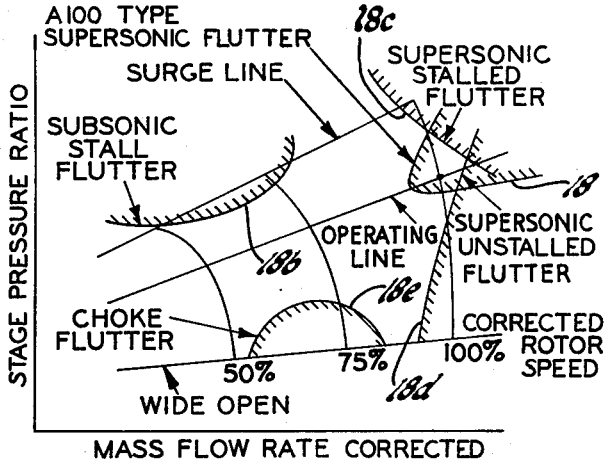
Figure 8A:
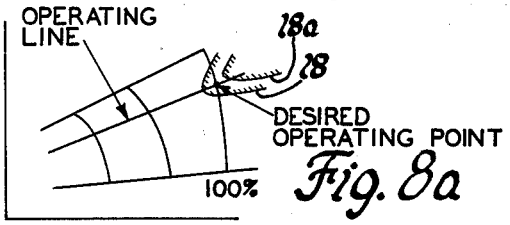
Figure 9:
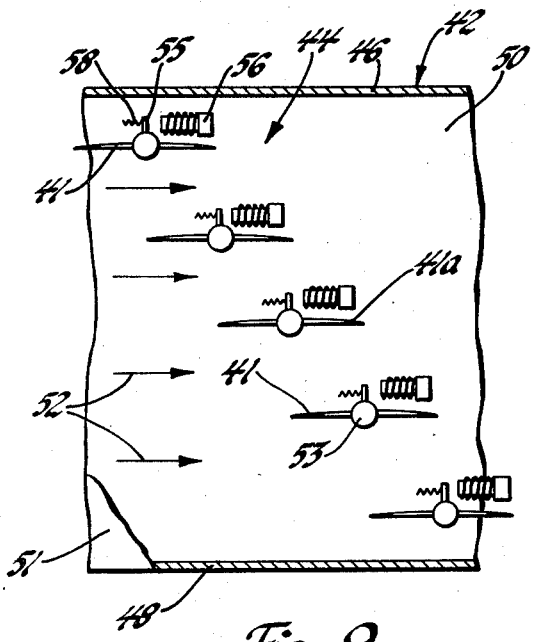
Figure 10:
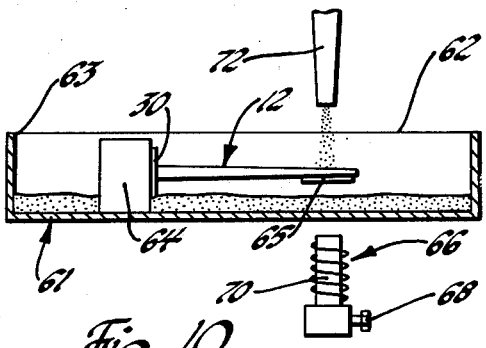
Figure 11:
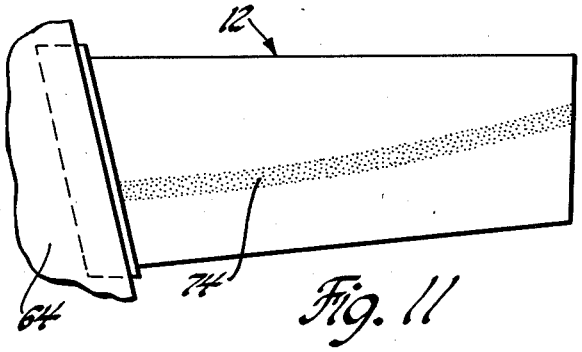

FIGS. 8 and 8*a* are charts showing performance characteristics of a typical compressor utilizing blades formed by the method of the present invention;

FIG. 9 is a diagrammatic view of a blade cascade arrangement used in the present invention;

FIG. 10 is a vane vibration apparatus for use in the method of the present invention; and FIG. 11 is an elevational view of a blade in the apparatus of FIG. 10 including a trace of a torsional mode node line thereon as produced at the first natural torsional vibration mode point thereof.

Figure 1:
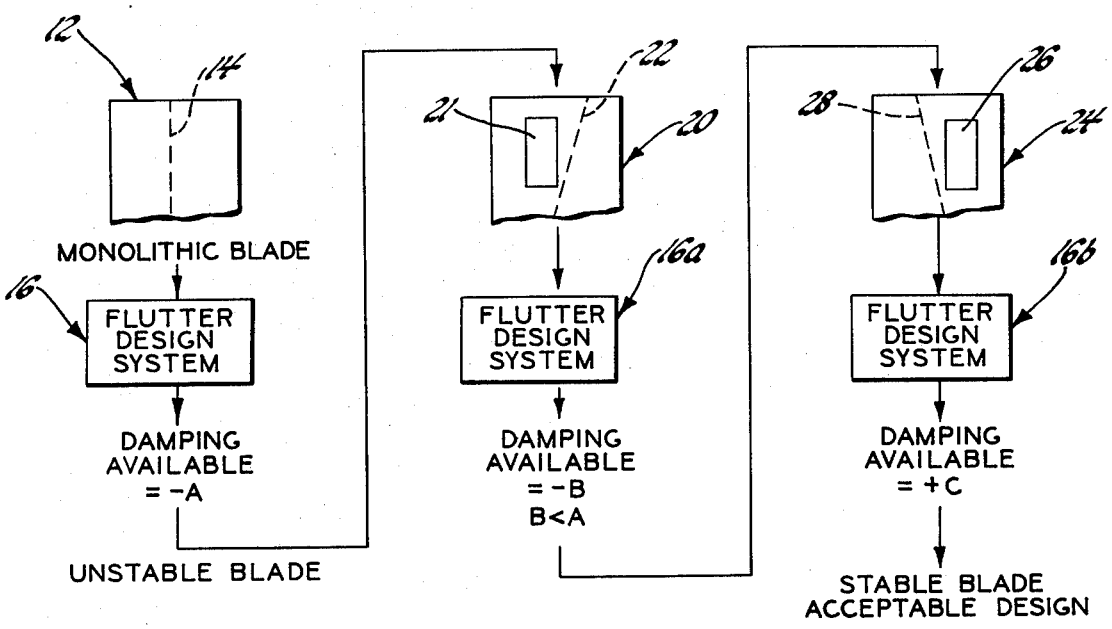
FIG. 1 is a diagrammatic view of a process sequence to produce a modified composite blade structure with flutter characteristics in accordance with the present invention.

In FIG. 1, a flow chart of an improved method for controlling the first torsional mode node line location in a rotatable blade of a turbomachine to improve the flutter stability of the blade is illustrated. The process includes use of a monolithic blade 12 having a first torsional mode node line 14 thereon which is subjected to a flutter design method 16 from whence the level of negative energy condition within the blade, that energy condition wherein energy is absorbed from the air flow thereacross which is one manifestation of a blade which is unstable to an engine operating mode that is within a flutter region.

A schematic of various compressor and fan flutter conditions is shown in FIG. 8 of the drawings. The possible flutter conditions include A100 type supersonic flutter, subsonic stall flutter, supersonic stalled flutter, supersonic unstalled flutter choke flutter (curves 18, 18*b*–18*c*, respectively) as shown in FIG. 8. As an example the method can be applied to A100 type supersonic flutter. The method further includes formation of an intermediate first composite blade 20 configured to have the same aerodynamic shape as the monolithic blade 12 but further including an inlay 21 of dissimilar material to that of the monolithic blade 12 which is added within the confines of the aerodynamic shape of the monolithic blade 12 to adjust the first torsional node line 22 of the composite blade 20 with respect to the first torsional mode node line 14. The first composite blade is resubjected to a flutter design method 16*a* to determine the damping available. The flow chart of FIG. 1 shows that the first composite blade 20 has a torsional node line location 22 which under the flutter design method 16*a* to be discussed results in an energy damping condition wherein the first composite blade 20 absorbs energy from the flow thereacross but at a level lesser than that which is absorbed by the monolithic blade 12. As diagrammatically shown, the method further includes formation of a modified first composite blade 24 having an inlay 26 of dissimilar material located in a position offset with respect to the position of the inlay 21 and adjusted with respect to the location of the inlay 21 to locate a first torsional node line 28 in a position so that when the modified first composite blade 24 is subjected to a flutter design method 16*b*, available damping will be positive to indicate that the modified first composite blade 24 adds energy to the air flow thereacross thereby to designate a blade stabilized against A100 type supersonic flutter thereby moving the flutter boundary 18 to the right of the desired 100% speed operating point as shown by the position of the flutter boundary line 18*a* in FIG. 8*a*. The above method can be similarly applied to the other types of flutter shown in FIG. 8.

Figure 2:
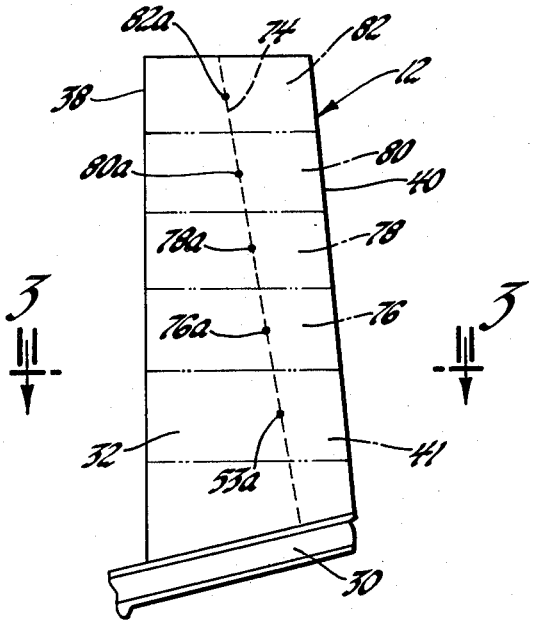
FIG. 2 is a side elevational view of a monolithic blade component of the improved method.
Figure 3:
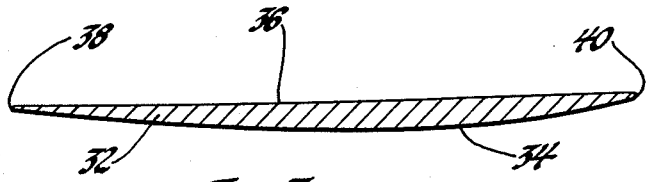
FIG. 3 is a top elevational view of the blade in FIG. 2 taken along the line 3—3 looking in the direction of the arrows.

Referring now more particularly to FIGS. 2 and 3 the monolithic blade 12 has a root portion or base 30 which is adapted to be rigidly connected within a turbomachine rotor. Radially outwardly of the base 30 the monolithic blade 12 includes an airfoil span 32 with a generally convex fluid directing pressure surface 36 and a generally concave fluid directing suction surface 34 which intersect at a leading edge 38 and at a trailing edge 40 directed radially outwardly of the base 30. The aerodynamic shape of the monolithic blade 12 is selected to retain desired fluid compressor operating characteristics including compressor efficiency and pressure ratio characteristics.

In practicing the present invention, a plurality of radial span segments 41 of each of the monolithic blades 12 are located within a cascade flow apparatus 42 as shown in FIG. 9. It includes an axial flow channel 44 bounded by side walls 46, 48, a bottom wall 50 and a top wall 51. The apparatus 42 thereby defines a flow tunnel having air flow therethrough, represented by the arrows 52 in FIG. 9, across each of the identical segments 41 of the blade 12 which are staggered with respect to one another and include a center located blade span segment 41*a* that is isolated from flow effects at the side walls 46, 48. Each of the span segments 41 or 41*a* have end trunnions 53, 54 connected thereto pivotally supported in top wall 51 and bottom wall 50. As shown in FIG. 9, each of the trunnions 53 includes a soft iron armature 55 secured thereto which is excited by an electromagnetic vibrator 56 with respect to a spring restoration system 58 so that each of the span segments 41, 41*a* can be vibrated at a first torsional mode of vibration.

Figure 4:
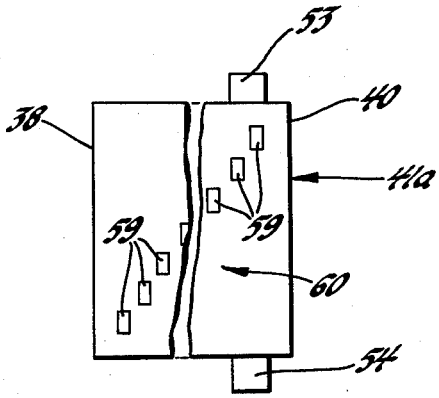
FIG. 4 is a side elevational view of a blade segment used in a step of the improved method.

In the illustrated arrangement, the span segment 41*a* is instrumented to include pressure transducers thereon to measure the pressure differential between the pressure and suction surfaces 34, 36, respectively. In one arrangement for measuring time unsteady aerodynamic pressure conditions on such a span segment of a monolithic blade 12, a Kulite pressure transducer 59 is utilized, for example, Kulite Model No. LQL-5-080. In the cascade apparatus 42, the center airfoil 41*a* is machined to include an array 60 of such embedded pressure transducers 59 each of them being located vertically along the span of the center span segment 41*a* at axially offset positions as shown in FIG. 4 to maintain the airfoil contour of the span segment and also to allow a smooth flow of air across the pressure transducers in the array 60. The output of the pressure transducer array 60, produced by the vibration of the blade segment 41*a* at the first torsional mode of operation, represents a partial chordwise integration of the total unsteady surface pressure effect acting on one spanwise location of the monolithic blades 12.

The location of the trunnions 53, 54 along the chord line of each of the span segments of the blade to be placed in the cascade array 42 is established by placing the monolithic blade 12 in a vibration apparatus 61 with sander 72 including a container 62 having an open end 63 and including a rigid mount 64 connected to the rigid base 30 of the monolithic blade 12. A soft iron armature 65 is connected near the tip of the monolithic blade 12 at a point vertically above an electromagnetic exciter 66 that includes a control knob 68 to vary the level of vibration of the blade 12 by cylical attraction of the soft iron armature 65 with respect to the electromagnet 70 of the exciter 66. The blade 12 thereby is cyclically elastically deformed as it vibrates at the first torsional natural vibration mode to produce a node line 74 thereon. Since there is no blade motion at this line, sand particles stand on the line to show the node line shape.

In the illustrated embodiment the torsional node line 74 on the blade 12 is shown at FIG. 2 and the span segment 41 is shown as being a span segment of the blade 12 which is located closely adjacent the base 30 of the blade 12. This blade span segment 41 has the trunnion point 53*a* located thereon at the intersection between the mid-line of the segment 41 and the torsional node line 74. Additionally, the method of the present invention will include unsteady pressure profiles on radially outwardly located span segments including span segments 76, 78, 80 and 82. These segments are each tested like the segment 41 but will have the trunnion connection points thereon displaced toward the leading edge of the blade. For example, the trunnion axis point where the blade segment 76 will be at point 76*a* representing the intersection of the segment 76 and the first torsional vibration mode node line 74. Likewise, the blade segments 78, 80 will have a trunnion axis established by the points 78*a*, 80*a* along the node line 74 and the segment 82 will have a torsional node line established by the point 82*a* along the torsional node line 74.

Each of the separate blade span segments 76, 78, 80, 82 are placed in the cascade array apparatus 42 as was the blade segment 41 and will be subjected to vibration thereof at the first torsional mode of vibration and will have an array of pressure transducers 60 on the mid-channel span therealong as in the case of the span segment 41*a* as shown in FIG. 4. The combination of steady supersonic flow 52 across each of the blade segments and the pressure pattern produced thereon as the blade segments are vibrated at the first torsional mode frequency will produce a plurality of pressure differential profiles that will produce a representation of a resultant unsteady pressure force on the blade produced by first torsional modes of operation to give an indication of the unsteady force on the monolithic blades to determine whether the monolithic blade is either absorbing energy from or adding energy to air flow represented by the illustrated supersonic flow 52 thereacross. In actuality, the aforesaid mode, while predominately torsional, is not a pure torsion mode since being mode components exist to produce some modification of the resultant pressure effects which would be produced by pure torsional modes of vibration.

Monolithic blades 12 typically have the possibility for an unstable flutter condition at the extremes of operation conditions. For example, see curve 18 of FIG. 8*a* which is A100 type supersonic flutter condition which can occur at higher speeds of fan rotation.

Figure 6:
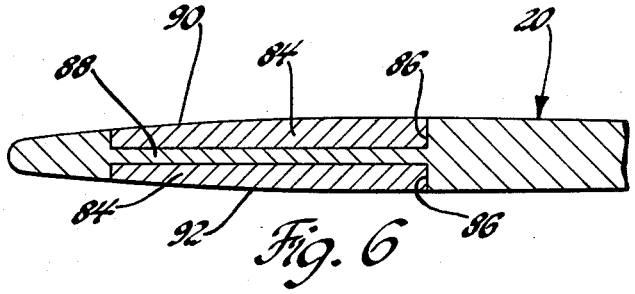
FIG. 6 is a fragmentary vertical sectional view taken along the line 6—6 of FIG. 5 looking in the direction of the arrows.
Figure 7:
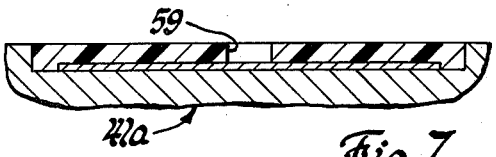
FIG. 7 is an enlarged fragmentary cross-sectional view of a pressure transducer used in the method of the present invention.

In accordance with the present invention, once it is determined that negative damping is available as shown in FIG. 1, representing an unstable blade or a blade which will exhibit flutter when the turbomachine is operated beyond the curve 18 of FIG. 8*a*, the node line location of the monolithic blade 12 will be adjusted from that shown at 74 as established by the vibration apparatus of FIG. 10 by the addition of an inlay 21 of dissimilar materials 84 within the confines of the pressure and suction surfaces 34, 36 of the orginal monolithic blade 12. A suitable type of inlay material is set forth in U.S. Pat. No. 3,717,443, issued Feb. 20, 1973, to MacMurray et al. While the material is representatively shown as being a high modulus of elasticity composite filament reinforced material other material having either greater or lesser modulus of elasticity and/or density than the base material of the monolithic blade 12 are suitable for use in practicing the method of the present invention. The dissimilar material inlay 21 is placed in a recess 86 within the confines of the pressure and suction surfaces 34, 36. The recess 86 in the illustrated embodiment as shown in FIG. 6 is formed on either side of a bridge segment 88 of the blade 20. The double walled recess 86 is layed up with filaments as set forth in the aforesaid MacMurray et al patent and a pair of opposed cover layers 90, 92 are welded to the blade airfoil around the periphery of the recess 86 and then the parts are diffusion bonded together by use of hot isostatic pressure techniques.

Figure 5:
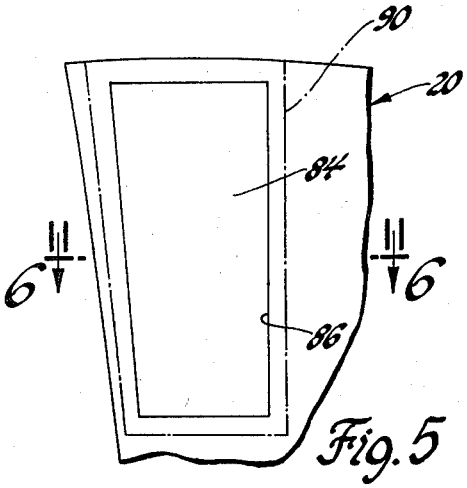
FIG. 5 is a fragmentary elevational view of a first composite blade in the method of the present invention.

The recess 86 shown in the fragmentary portion of the blade 20 illustrated in FIGS. 5 and 6 is representative of one configuration for a first composite blade such as that shown in 20 in FIG. 1. The torsional node line 22 of this blade is, by virtue of the aforesaid inlay 21, shifted with respect to the torsional node line 74 of the monolithic blade 12.

The actual location of the torsional node line 22 is established by placing the first composite blade structure 20 in the vibration apparatus 61 and subjecting it to vibration at the first torsional mode to produce a first torsional node pattern on the first composite blade structure 20 which is diagrammatically shown at 22 in FIG. 1. The blade 20 is divided into a plurality of radial span segments like the blade 12 in FIG. 2. The point at which the modified torsional node line 22 intersects the vertical midpoint of each of the radial span segments will determine the axial position of trunnions corresponding to trunnions 53, 54 on the blade segment 41*a* in FIG. 4. An array of each of the span segments of the blade 20 will be located in the cascade apparatus 42 and subjected to vibration at the first torsional mode frequency of the first composite blade structure 20 as established by the apparatus 61.

Each of the groups of the radial span segments located in the apparatus 42 will have a mid-blade like 41*a* in FIG. 9 with an array of pressure transducers 59 located thereon to record the amount of unsteady pressure acting on each of the radial blade span segments of the first composite blade 20. The resultant force produced by the unsteady pressures recorded on each of the span segments of blade 20 will produce a resultant pressure effect which determines a resultant force and whether or not the first composite blade 20 either absorbs or contributes energy to the steady supersonic air flow thereacross.

As shown in the process of FIG. 1, the location of the inlay 21 in the upper left hand corner of the first composite blade 20 results in energy transfer from the flow 52 to the modified blade 20 and indicates a blade unstable to flutter conditions such as those shown by the limit line 18 in FIG. 8. However, in the representatively illustrated case, the first composite blade 20 has less instability than the monolithic blade 12.

In accordance with the present invention, the energy absorption characteristics of the unstable monolithic blade 12 are compared to the energy absorption characteristic of the first composite blade 20 to indicate whether or not an addition of dissimilar material should be shifted from the leading edge toward the trailing edge of the first composite blade 20. The mass and location of the added dissimilar material is adjusted in accordance with the degree of improved aerodynamic damping or degree of lesser negative aerodynamic damping because of the torsional node line shift produced in the first composite blade 20 by the inlay 21 therein.

The adjusted mass of dissimilar material is representatively shown at a trailing edge location of an inlay 26 on the upper right corner of the blade 24. Blade 24 represents a modified first composite blade.

This modified first composite blade 24 is placed in the vibration apparatus 61 and a still further shift of a first torsional node line 28 is located thereon. The modified first composite blade 24 is then divided into a plurality of radial span segments as was the blade 12 as shown in FIG. 2 and the intersection points between the vertical midlines of each of the span segments and the first torsional node line 28 are determined to locate the longitudinal axis of trunnions corresponding to trunnions 53 and 54. Groups of each of the radial span segments of the modified first composite blade 24 are located in the cascade array 42, and the mid-blade of each of the groups of span segments will have an array of pressure transducers such as array 60 in FIG. 4 located thereon and the blades will be driven by the electromagnetic vibrator 56 at the first torsional mode frequency of the modified first composite blade 24 to produce a representation of unsteady pressure conditions across the chord line of the modified first composite blade 24. The unsteady pressure condition is measured for each of the radial span segments that are located in groups in the array 42 to produce a representation of the total unsteady pressure condition acting from the base of the modified first composite blade 24 to the tip thereof to further optimize the aerodynamic damping produced by the relocation of the dissimilar material in the modified first composite blade 24. At this stage of the process, as shown in FIG. 1, the adjustment of the position of the first torsional mode node line on the blade to produce aerodynamic damping and resultant stabilization of the blade against supersonic flutter such as that shown by the limit line 18 in FIG. 8, is bracketed so that the blade 24 will direct energy into the air flow 52 thereacross under unsteady supersonic and subsonic air flow conditions.

The modified first composite blade 24 thereby represents a blade which will have improved supersonic flutter stability and accordingly the limit line of operation of a fan or compressor or like turbomachine blade will be shifted to the right as shown in FIG. 8*a* as represented by supersonic flutter curve 18*a* (A100 type).

It is possible that the shifted inlay 26 of the modified first composite blade 24 will have a planar extent and axial offset location with respect to the inlay 21 so that there will still be a small degree of negative damping of the type found with the first composite blade 20. In this event, a further adjustment of the inlay size and location can be made and the still further modified blades can be resubjected to a vibration analysis in apparatus such as that shown in FIGS. 10 and 11 and a redetermination of unsteady pressure across a plurality of radial segments of the adjusted blade determined for further fine tuned compensation and adjustment of flutter stability under unsteady subsonic, transonic and supersonic flow conditions of operation.

While the embodiments of the present invention, are herein disclosed, constitute a preferred form, it is to be understood that other forms might be adopted.

We claim:

1. A method for controlling the first torsional node line position in a rotatable blade of a turbomachine to improve its flutter stability including the steps of: forming a first monolithic blade having an airfoil shape with convex and concave side walls; arranging several of the monolithic blade shapes in a cascade array and subjecting the cascade array to an unsteady flow condition and thereafter determining the unsteady surface pressure forces acting on the monolithic blades; independently determining the first torsional node line of each of the monolithic blades and comparing the resultant surface pressure force on the monolithic blades and its relationship to the first torsional node line to determine whether or not the monolithic blade is absorbing or adding energy to the air flow thereacross; thereafter forming a plurality of first and subsequently modified composite blades by adding dissimilar material to the blade shape of said monolithic blade within the confines of its convex and concave side walls with the location of the dissimilar material and the amount of the dissimilar material being determined by subjecting the first composite blade and modifications thereof to unsteady flow conditions while the first composite blades and modification thereof are located in a cascade array to determine the resultant unsteady surface pressures thereon and comparing such unsteady surface pressures to the location of an independently determined first torsional vibration mode node line positions of the first composite blades and modifications thereof so as to optimize the location of their first torsional vibration mode node line with respect to unsteady surface pressures produced thereon under unsteady flow conditions so as to produce a flutter stable blade.

2. A method for controlling the torsional node line location of a rotatable blade of a turbomachine to improve its flutter stability including: forming a first monolithic blade having a root portion and an airfoil shape with convex and concave side walls thereon; arranging several of such monolithic blade shapes in a cascade flow array and subjecting the cascade array to an unsteady condition of flow thereacross; determining the unsteady surface pressures on the monolithic blades under the aforesaid flow conditions; determining the torsional mode node line shape of the monolithic blade and the natural frequency of the first torsional mode vibration in the monolithic blade; comparing the location of the aforesaid blade vibration node line with the resultant unsteady force produced by the unsteady pressure conditions on the monolithic blade to determine whether the monolithic blade is absorbing energy from or adding energy to the air flow thereacross so as to determine whether the blade is flutter stable or flutter unstable; changing the first torsional mode vibration node line position of each of the monolithic blades in accordance with the preceding comparison by adding dissimilar material to the blade shape of the monolithic blade within the confines of its convex and concave side walls to produce a shift in the aforesaid torsional node line with respect to the leading edge of the monolithic blade to produce a first composite blade, arranging several of the first composite blades in a cascade array and subjecting them to the same unsteady supersonic and subsonic flow conditions to redetermine unsteady surface pressure acting on the first composite blade; comparing the first torsional vibration mode node line shape and frequency of vibration of the first composite blade and the resultant force produced by the unsteady surface pressures acting on the first composite blade to determine whether or not the first composite blade is either absorbing or contributing energy to the unsteady supersonic and subsonic air flow thereacross, thereafter comparing the energy absorption level of the first monolithic blade to that of the first composite blade and readjusting the size and location of the dissimilar material on the first composite blade if it is adding energy to the air flow and thereby to produce a modified first composite blade structure, and resubjecting the modified first composite blade structure to unsteady supersonic and subsonic conditions and determining the unsteady surface pressures thereon and comparing the first torsional vibration mode node line shape and frequency of vibration of the modified first composite blade with the unsteady pressure conditions thereon to determine the energy absorbing and/or adding characteristics of the modified first composite blade so as to cause the modified first composite blade to direct energy into the air flow thereacross under unsteady supersonic and subsonic air flow conditions to produce a flutter stable blade.

3. A method for controlling the torsional node line location in a rotatable blade of a turbomachine to improve flutter stability of the blade comprising the steps of: forming a monolithic blade having a root portion for connection to a rotor and having a desired airfoil shape with convex and concave sidewalls joined at a leading and a trailing edge, arranging the monolithic blade shapes in a cascade array, subjecting the cascade array of monolithic blades to a flow thereacross to determine unsteady pressures on individual ones of said monolithic blades, determining the natural vibration mode node line shape and frequency therein at the first natural torsional mode frequency of said monolithic blade, comparing the aforesaid blade vibration mode node line shape and frequency along with the unsteady pressure conditions of said monolithic blade to determine the amount of energy absorption by said blade in its monolithic state, producing a first composite blade and changing the node line position of said monolithic blade by adding dissimilar material to the blade shape thereof within the confines of the convex and concave sidewalls thereof, subjecting said first composite blade to an unsteady flow condition thereacross to determine unsteady surface pressures acting on said first composite blade, determining the torsional mode line shape of said first composite blade at the first torsional natural vibration mode thereof, comparing the blade vibration mode node line shape of the first composite blade with the unsteady surface pressures acting thereon and determining whether the first composite blade is either absorbing or contributing energy to the unsteady flow condition thereacross, comparing the energy absorption of the monolithic blade to that of the first composite blade and shifting the amount of dissimilar material along the chord of the monolithic blade to further shift the torsional mode node line thereof to produce a modified first composite blade, resubjecting the modified first composite blade to unsteady flow conditions to determine the unsteady surface pressures present thereon, determining and comparing the blade vibration mode node line shape and frequency of the modified first composite blade to determine whether the modified first composite blade is absorbing and/or adding energy to the flow condition thereacross until the modified first composite blade is directing energy into the flow condition thereacross under unsteady flow conditions, thereby to produce a flutter stable blade.

* * * * *